US006583363B1

(12) United States Patent
Wilson, Jr.

(10) Patent No.: US 6,583,363 B1
(45) Date of Patent: Jun. 24, 2003

(54) FENCE OR POST MOUNTED INSULATOR

(76) Inventor: Robert M. Wilson, Jr., 8680 Betterly Rd., Battle Creek, MI (US) 49016

( * ) Notice: Subject to any disclaimer, the term of this patent is extended or adjusted under 35 U.S.C. 154(b) by 0 days.

(21) Appl. No.: 10/337,504

(22) Filed: Jan. 7, 2003

(51) Int. Cl.[7] ..... H01B 17/14

(52) U.S. Cl. ..... 174/158 F; 174/161 F; 256/10; 256/DIG. 3

(58) Field of Search ..... 174/154, 158 F, 174/161 F, 163 F; 248/65; 256/10, DIG. 3, DIG. 5; D13/132

(56) References Cited

U.S. PATENT DOCUMENTS 3,652,780 A * 3/1972 Wilson ..... 174/45 R
3,820,758 A * 6/1974 Berg et al. ..... 256/10
4,028,489 A * 6/1977 Berg et al. ..... 174/166 R
4,077,611 A * 3/1978 Wilson ..... 256/10
4,599,488 A * 7/1986 Wilson, Jr. ..... 174/158 F
4,771,137 A * 9/1988 Thompson ..... 174/163 F
4,866,218 A * 9/1989 Wilson, Jr. ..... 174/158 F
4,982,932 A * 1/1991 Baker ..... 256/47
5,085,409 A * 2/1992 Teixeira ..... 256/48
5,959,255 A * 9/1999 Langlie et al. ..... 174/161 F
6,380,490 B1 * 4/2002 Gaston ..... 174/158 F

* cited by examiner

*Primary Examiner*—Dean A. Reichard
*Assistant Examiner*—Adolfo Nino
(74) *Attorney, Agent, or Firm*—Gifford, Krass, Groh, Sprinkle, Anderson & Citkowski, P.C.

(57) ABSTRACT

A unitary insulator of plastic material for supporting an electrified conductor wire in a horizontal position when the insulator is fastened to either a vertical post or is rotated slightly and is fastened to the diagonally extending wires of a chain link fence.

11 Claims, 2 Drawing Sheets

FENCE OR POST MOUNTED INSULATOR

FIELD OF THE INVENTION

This invention relates to insulators for supporting an electrified conductor wire used in electric fences in a horizontal position and more particularly an insulator capable of mounting on either a vertical post or on the diagonal wires of a chain link fence.

BACKGROUND OF THE INVENTION

Insulators for supporting electrified conductor wires in a horizontal position are provided in a variety of forms for supporting the conductor wires horizontally from metal or wooden posts or from chain link fences. Insulators for supporting electrified conductor wires from either vertical metal posts or from a chain link fence have been known since the grant of U.S. Pat. No. 3,652,780 to Robert M. Wilson. Although this patent discloses the support of insulators from vertical posts, both were sold and used for mounting on chain link fences. In such fences, the wires of the fence are disposed at a diagonal and form a generally diamond shaped pattern. When used with such chain link fences, the attaching arms of the insulator unit that are normally engagable with opposed vertical sides of a metal vertical post are attached to a pair of adjacent diagonal wires of a chain link fence. Such mounting displaced the conductor supporting portion approximately 45 degrees but was easily remedied by rotating the conductor supporting portion relative to the remaining separate parts of the insulator so that the wires could be supported horizontally. With the advent of plastics, electric fence insulators began being made as a single unit rather than of multiple parts thereby avoiding the costs of labor-intensive assembly. One example of a unitary insulator adapted for use with chain link fences is disclosed in U.S. Pat. No. 5,959,255. In that patent the mounting structure for holding the unit to a chain link fence and the insulator for supporting the wire in the horizontal position are displaced approximately 45 degrees and are fixed in that position relative to each other. As a consequence, this insulator is suitable only for use with a chain link fence and a different insulator is required for mounting on vertical posts in order to maintain a conductor wire in a horizontal position in both instances.

SUMMARY OF THE INVENTION

There is a need for a unitary insulator, which can be mounted on either a vertical post or on diagonal wires of a chain link fence to obviate the need to have two different insulators available.

It is an object of the invention to provide a unitary insulator for supporting an electrified conductor wire in a horizontal position from either a vertical post or from a chain link fence having crossed, diagonal wires.

Another object of the invention is to provide an insulator having a conductor wire holding portion, which prevents the accidental removal of the conductor wire from the holding portion in any of its operative positions.

The objects of the invention attained by an insulator formed as a single homogenous unit of non-conducive plastic material in which a mounting structure including a pair of deflectable fingers are arranged to engage and grip either the opposed vertical edges of a post or an adjacent pair of diagonal wires of a chain link fence. In either of its positions the insulator supports an electrified conductor wire of an electric fence without interference from any portion of the insulator by means of a pair of conductor holding elements fixed in spaced apart relation to receive a conductor wire therebetween and to support it without axial resistance in a horizontally extending passage from which removal is prevented except intentionally.

DETAILED DESCRIPTION OF THE PREFERRED EMBODIMENT

Figure 1:
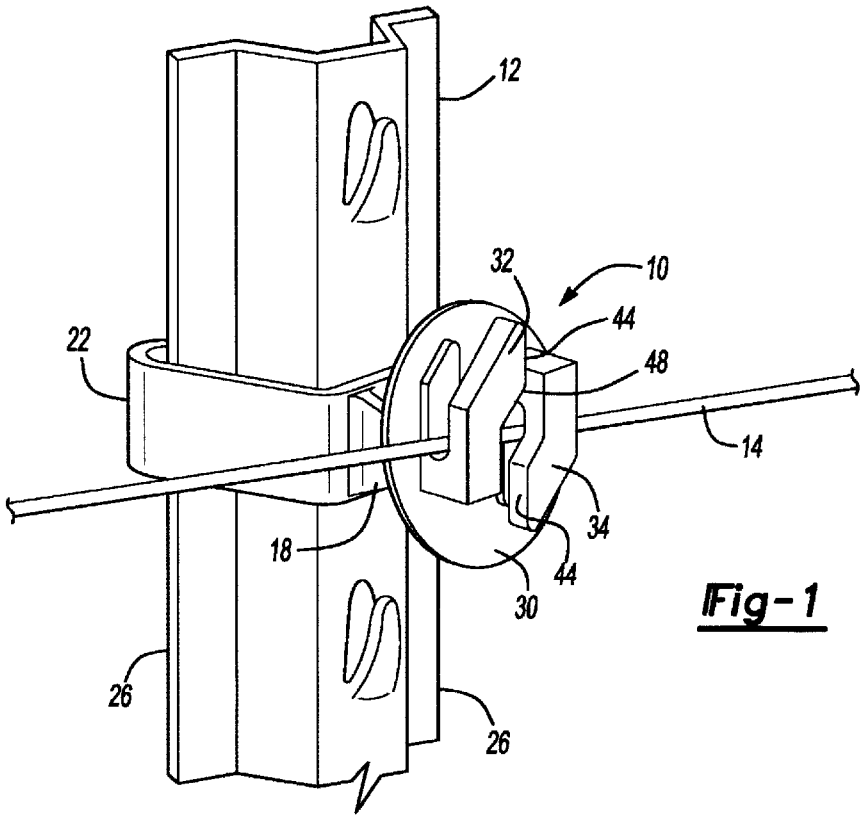
FIG. 1 is a perspective view of the insulator embodying the invention installed on a vertical steel post.
Figure 2:
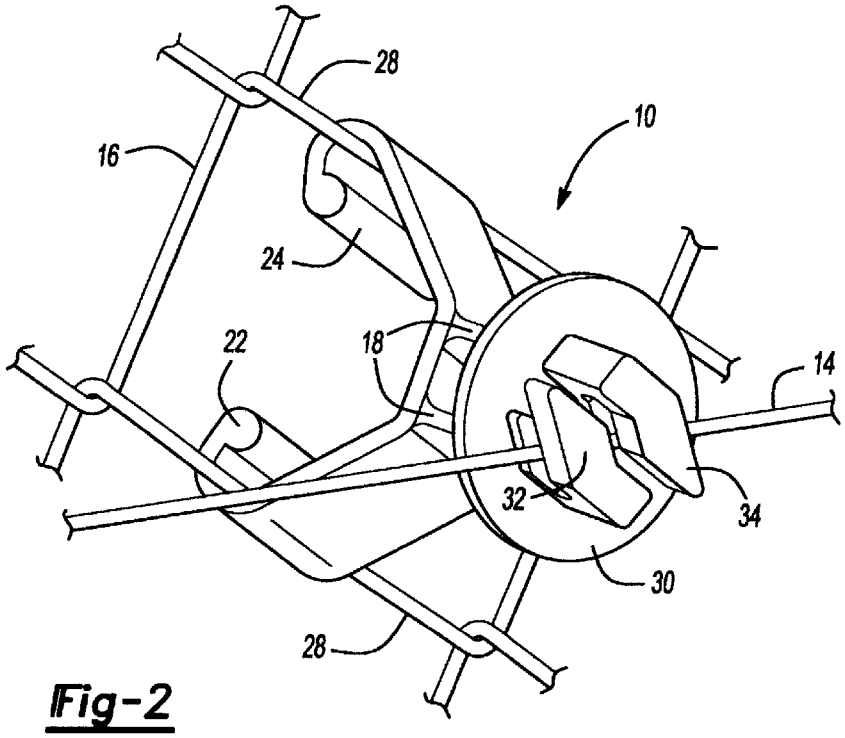
FIG. 2 is a view of the insulator seen in FIG. 1 installed on a chain link fence.

The preferred embodiment of the invention is in the form of an insulator 10 that is made of a non-conductive, plastic material and can be mounted on either a vertical post 12 as seen in FIG. 1 or on a chain link fence 16 as seen in FIG. 2 to support an electric conductor wire 14 horizontally.

The insulator 10 has a body portion 18 with one end having a mounting structure 20 including a pair of opposed, deflectable hook-like fingers 22 and 24. The opposed fingers 22 and 24 are adapted to engage opposite vertical edges 26 of a vertical metal post 12 as seen in FIG. 1 or to engage the opposed parallel wires 28 making up the chain link fence as seen in FIG. 2.

The forward end of the body portion 18 opposite the mounting structure 20 is provided with a faceplate 30 that in the preferred embodiment of the invention is shown as being generally circular but it can be of other forms. The faceplate 30 supports a pair of conductor holding elements 32 and 34.

The body portion 18 can be of a wide range of lengths to support a conductor wire 12 in a desired spacing from the post 12 or chain link fence 16.

Each of the conductor holding elements is generally U-shaped in configuration with an inner leg 36 and an outer leg 38 joined together by a bight portion 40. The inner legs 36 of each of the U-shaped conductor holding elements 32 and 34 is formed integrally with the face plate 30 and the open ends of the U-shaped elements face in opposite directions. The open end of the conductor holding element 32 is open upwardly and the open end of the conductor holding element 34 is open downwardly as seen in FIGS. 1, 2, 3 and 4. The holding elements may also be regarded as hooks facing in opposite directions with the bight 40 forming a horizontal portion and the outer leg 38 forming a vertical upwardly extending portion in the case of holding element 32 and a vertically downwardly extending leg portion of the holding element 34.

Figure 4:
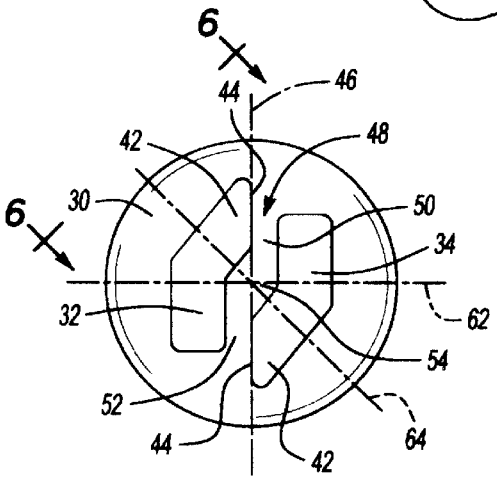
FIG. 4 is an end view of the insulator seen in FIG. 3.

As best seen in FIG. 4, the free end 42 of the outer leg 38 of the conductor holding element 32 tapers inwardly toward the bight portion 40 of the other conductor holding element 34. Similarly the free end 42 of the outer leg 38 of the other of the conductor holding element 34 tapers inwardly toward the bight portion 40 of the conductor holding element 32. The outer ends 42 of each of the outer legs 38 of the two conductor holding elements 32, 34 have facing surface portions 44 that are disposed in a common imaginary plane passing through a line designated at 46 in FIG. 4. It will be noted that the configuration of the outer legs 38 is such that their disposition relative to each other forms a continuous vertical slot 48 having an upper portion 50 and a lower portion 52 offset from each other and connected together by an angularly disposed slot portion 54. The offset slot portions permit the insertion of a conductor wire into a conductor holding passage 60 formed by the two conductor holding elements 32,34 and prevents its accidental displacement for all positions of the insulator 10 when connected to the vertical sides of a post or to the diagonal wires of a chain link fence.

Figure 3:
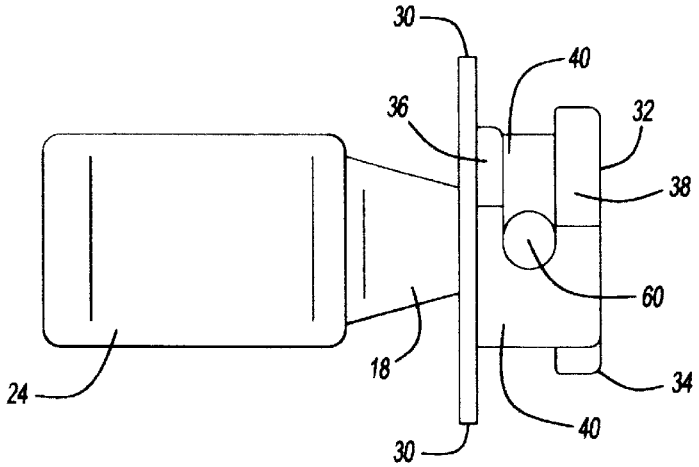
FIG. 3 is a side elevation of the insulator.
Figure 5:
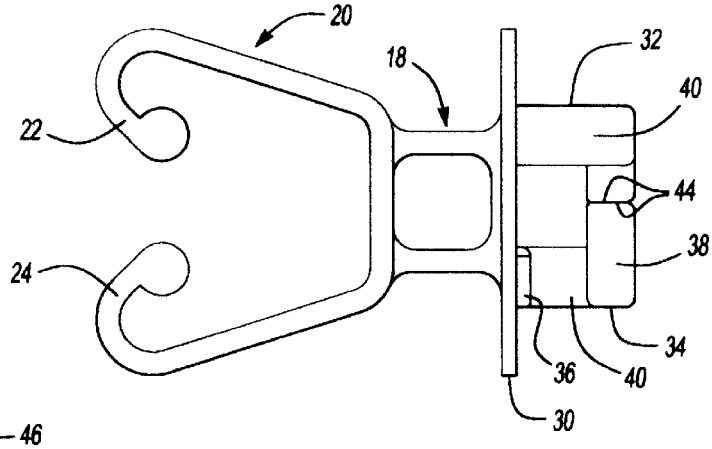
FIG. 5 is a top plan view of the insulator seen in FIG. 3.
Figure 6:
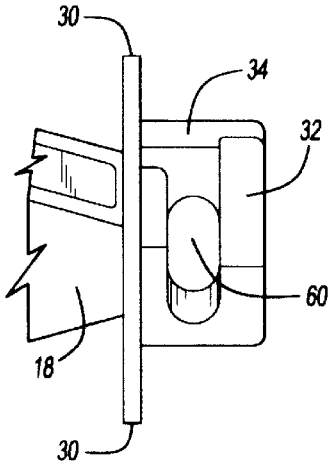
FIG. 6 is a view of a portion of the insulator taken along line 6—6 in FIG. 4.

It will be noted that the horizontal passage 60 as seen in FIG. 3 will support a conductor wire 14 having its axis extending horizontally as designated at line 62 in FIG. 2 when the insulator 10 is connected to a vertical post 12 as seen in FIG. 1. Also, when a conductor wire 14 is supported from a chain link fence as shown in FIG. 2, its axis, designated at line 64, is displaced approximately 45 degrees relative to the insulator 10 as best seen in FIG. 4. In that case, the conductor supporting passage 60 appears elongated as shown in FIG. 6. In both conditions, the conductor wire 14 is disposed horizontally in the passage 60 without binding or bending.

The insulator 10 is formed as a unitary member of plastic, non-conducting material and permits the mounting on either a vertical metal post 12 or the diagonal wires of a chain link fence 16 and still supports the wire in a horizontal position.

To place the conductor 10 on a post 12 the hook fingers 22 and 24 are deflected away from each other and allowed to return to their as-molded condition to firmly engage the opposed post edges 26 of post 12 as viewed in FIG. 1. In this position the conductor wire is supported horizontally with its axis at 62 as illustrated in FIG. 4.

Similarly, to place the conductor 10 on a chain link fence 16 as seen in FIG. 2, the fingers deflected away from each other and allowed to return toward their as-molded condition to firmly engage a pair of adjacent fence wires 28. The conductor wire 14 is supported horizontally but its axis indicated at line 64 is displaced approximately 45 degrees relative to the axis indicated at 62 when the conductor is attached to a post 12. In both cases the conductor wire 14 is supported horizontally even though the conductor 10 has been rotated counterclockwise approximately 45 degrees between its post-supported positions seen in FIG. 1 and its chain link fence supported position seen in FIG. 2.

A unitary insulator has been provided which is made of a non-conductive plastic material and makes it possible to support the insulator from either a vertical post or from the diagonal wires of a chain link fence and still horizontally support an electrified conductor wire.

I claim:

1. An insulator for supporting an electrified conductor wire in a generally horizontal position, comprising:

a body member extending generally horizontally in use and perpendicular to a conductor wire to be supported;

a mounting structure formed integrally at one end of said body member and including a pair of deflectable fingers selectively engageable with a selected one of the opposed vertical surfaces of a vertical post and the opposed diagonal wires of a chain link fence;

a vertical face plate formed integrally at the other end of said body member;

a pair of conductor holding elements extending from said face plate, said elements being disposed in spaced adjacent relation to each other, said elements being U-shaped to form wire conductor slots extending vertically and each having an end opening in opposite directions from each other, said slots being elongated and acting jointly to form a vertically elongated wire passage permitting a conductor wire to be supported horizontally in either of two mounting positions of said mounting structure when it is attached to a selected one of the diagonal wires of a chain link fence and a vertical post.

2. The insulator of claim 1 wherein said conductor holding elements are spaced apart a distance forming a gap permitting insertion of a conductor wire into said wire passage.

3. The insulator of claim 2 wherein said gap has upper and lower portions off-set from each other to resist removal of a wire in said wire passage in either of said two mounting positions of said mounting structure.

4. The insulator of claim 1 wherein said U-shaped elements have a pair of legs connected by a bight portion and wherein the outer ones of said leg elements have end portions longer than the inner ones of said leg elements.

5. The insulator of claim 4 wherein the free ends of said outer legs extend vertically beyond said bight portion of the other of said U-shaped elements when said mounting structure is attached to a vertical post.

6. The insulator of claim 4 wherein the free ends of said outer legs are substantially equal vertically to said bight portion of the adjacent U-shaped element when said mounting structure is attached to the opposed diagonal wires of a chain link fence.

7. The insulator of claim 4 wherein said end portions of each of said legs extend toward the bight of the adjacent U-shaped element.

8. An insulator for supporting a conductor wire horizontally from a vertical post or from diagonally extending wires of a chain link fence, comprising:

an elongated, unitary insulator;

a mounting structure formed at one end of said insulator and including a pair of deflectable fingers selectively engageable with a selected one of the opposed vertical surfaces of a vertical post and the opposed diagonal wires of a chain link fence;

a face plate formed integrally at the other end of said insulator and disposed vertically when in use; and a pair of laterally spaced-apart wire supporting hook elements extending outwardly from said face plate, said hooks each comprising a horizontal portion extending from said face plate and a vertical portion extending upwardly from the end of one of said horizontal portions and extending downwardly from the end of the other of said horizontal portions, said hook elements acting together to form a wire supporting passage which is vertically elongated and permits support of a horizontal conductor wire when the mounting structure is engaged with a selected one of a vertical post and a diagonal wire of a chain link fence.

9. The insulator of claim 8 wherein said supporting elements are spaced apart a distance forming a gap permitting the insertion of a conductor wire into said wire passage.

10. The insulator of claim 8 wherein said horizontal portions of said supporting elements are spaced apart vertically a predetermined distance when said insulator is attached to a vertical post and wherein said horizontally extended portions are spaced apart a greater distance vertically when said insulator is attached to the opposed diagonal wires of a chain link fence.

11. The insulator of claim 9 wherein said gap between said supporting elements has upper and lower portions off-set from each other to resist unintentional removal of a conductor wire.

* * * * *